US005398930A

United States Patent [19]

Gibson

[11] Patent Number: 5,398,930

[45] Date of Patent: Mar. 21, 1995

[54] GOLF GRIP

[75] Inventor: Jeremy H. Gibson, Eastlake, Ohio

[73] Assignee: Faye Chen, Ann Arbor, Mich.

[21] Appl. No.: 132,046

[22] Filed: Oct. 5, 1993

[51] Int. Cl.[6] ..... A63B 53/14

[52] U.S. Cl. ..... 273/81.4; 273/81 B

[58] Field of Search ..... 273/81 R, 81 B, 81 D, 273/165, 81.2, 81.3, 81.4, 81.5, 81.6, 187.4, 187.5, 75, 67 R, 67 DA, 67 DB

[56] References Cited

U.S. PATENT DOCUMENTS

| | | | |
|---|---|---|---|
| 156,578 | 12/1849 | Strazza . | |
| 215,314 | 9/1869 | Jackson . | |
| 1,213,014 | 1/1917 | Rees | 273/81 R |
| 1,419,795 | 6/1922 | Yerger | 273/81.2 |
| 1,768,933 | 7/1930 | Riley . | |
| 1,822,212 | 9/1931 | Griffiths . | |
| 1,982,526 | 11/1934 | Lussky | 273/81.4 |
| 2,046,191 | 6/1936 | Smith . | |
| 2,141,519 | 12/1938 | Cunningham | 273/81.4 |
| 2,298,505 | 10/1942 | Ottman | 273/81.4 |
| 2,437,404 | 3/1948 | Robinson | 273/81.4 |
| 2,482,120 | 9/1949 | Mishkinis | 273/81.4 |
| 2,704,668 | 3/1955 | Park, Sr. . | |
| 3,173,689 | 3/1965 | Serblin . | |
| 4,374,589 | 2/1983 | Strickland | 273/75 |
| 4,511,147 | 4/1985 | Olsen . | |
| 4,629,191 | 12/1986 | Mancuso | 273/81.4 |
| 4,979,743 | 12/1990 | Sears . | |
| 5,087,042 | 2/1992 | Solheim | 273/81 R |

FOREIGN PATENT DOCUMENTS

| | | | |
|---|---|---|---|
| 27827 | of 1898 | United Kingdom | 273/81.4 |
| 20882 | 11/1908 | United Kingdom | 273/81 B |
| 201621 | 8/1923 | United Kingdom | 273/81 B |
| 483995 | 4/1938 | United Kingdom | 273/81 B |
| 2031283 | 4/1980 | United Kingdom . | |

*Primary Examiner*—Sebastiano Passaniti
*Attorney, Agent, or Firm*—Frank B. Robb

[57] ABSTRACT

Golf grips for attachment to the shaft of a golf club which are adapted for use by individuals including those having physical disabilities such as arthritis or an infirm grip are provided. The golf grips are formed from an elastomeric material and include integral first and second sections. Both the first and second sections include a forward portion having a substantially rectangular shape in cross-section and a rearward portion having a substantially elliptical shape in cross-section. The first forward portion includes a radially outwardly extending flange disposed along a top surface of the grip and a radially outwardly extending hilt disposed along an underside surface of the grip. Another radially outwardly extending flange is provided along the second forward portion.

21 Claims, 4 Drawing Sheets

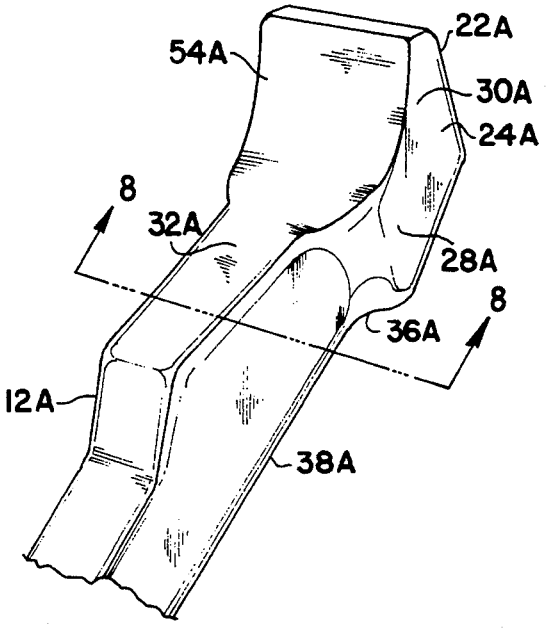
FIG. 7
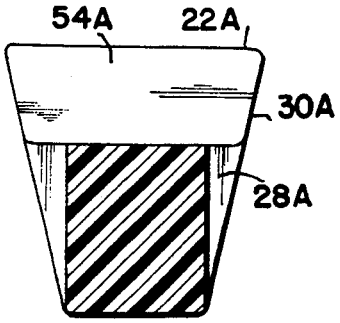
FIG. 8
FIG. 9
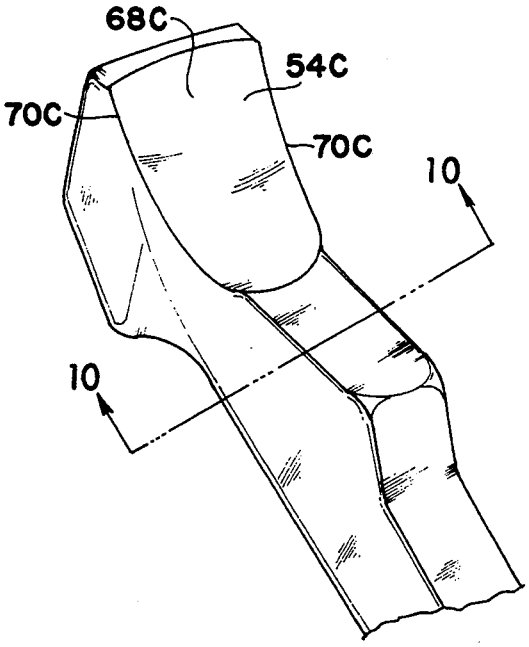
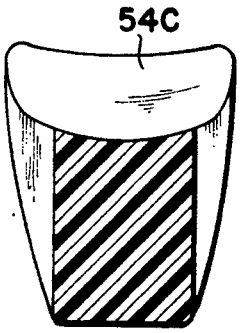
FIG. 10

GOLF GRIP

BACKGROUND OF THE INVENTION

I. Field of the Invention

The present invention relates generally to golf grips, and more particularly to golf grips which assist the golfer in achieving the correct positioning of their hands over the golf club.

II. Discussion

Two common problems for golfers relating to improper gripping of the golf club are that the right and left hand positions are incorrectly positioned on the grip and that golfers tend to grip the club unnecessarily firm so as to interfere with the coordination of the golf swing. With regard to proper hand positioning, often golfers fail to slightly overlap both the left and right hands relative to the center-line of the club shaft when gripping the club. As a result a number of products have been developed to assist the golfer in obtaining a properly overlapped grip. For example, U.S. Pat. No. 2,046,191 which issued Jun. 30, 1936 to Arthur R. Smith discloses a molded grip having means for separating the second and third fingers of the left hand from the forefinger and smaller finger. The means for separating the second and third fingers of the left hand from the forefinger and little finger include a pair of spaced apart projections wherein the two middle fingers are positioned between the projections and the forefinger and little finger are positioned on opposite sides of each of the projections. The means for positioning the thumbs include depressions spaced apart along the shaft for receiving the right and left thumbs such that they partially overlap the golf club shaft. One problem with the aforementioned grip is that the projections and depressions provided along the grip actually encourage the golfer to grip the club with excessive pressure which is undesirable.

Another golf grip which is designed to accommodate a golfer's fingers such that the thumb and forefingers of each hand are positioned in a partially overlapping or relative V-position along the top of the shaft is disclosed in U.S. Pat. No. 4,511,147 which issued Apr. 16, 1985 to Olsen. This grip includes a V-shaped projection raised from the surface of the grip along the top of the grip and a plurality of notches or grooves for receiving the golfer's fingers disposed on the underside of the grip. Likewise, a second V-shaped projection is spaced apart along the grip for hosting the thumb and forefinger of the golfer's other hand. Again, notches or grooves are provided on the underside of the grip for hosting the golfer's fingers of the other hand. One perceived problem with the aforementioned grip is that the grip is not compatible for golfers having extraordinarily large or small hands.

Another problem with the aforementioned golf grip embodiments is that they generally are not suitable for use by older individuals and those which have a physical disability such as arthritis or an infirm grip. Under many known golf grip embodiments individuals who have arthritis may have difficulty positioning their hands relative to the various projections and grooves which are provided. Quite simply, no variance from the set hand positions would be allowed by such grips.

Regardless of the overall construction of the golf grip, one problem common to the use of all known golf grips is the misalignment of the grip over the golf club shaft upon attachment. Too often when the grips are attached to the shafts, either mechanically or manually, the grip is rotated away from the perceived center-line or is twisted slightly when applied. This misalignment of the grip is especially problematic when specialized grips which include some means for proper hand orientation such as raised projections, embossments or imprints are used. Clearly, when means are provided on the grip for proper orientation of the hands, it is imperative that the grip be aligned properly over the shaft upon attachment. Until now the entire focus of specialized golf club grips has been only with the grip itself, and little or no consideration has been given to proper aligning of the golf club grip on the golf shaft.

SUMMARY OF THE INVENTION

In light of the foregoing discussion, the primary object of the present invention to provide a golf grip for use by a golfer to not only grip the club with proper hand positions but also to accommodate those individuals having a physical disability such as arthritis or an infirm grip.

Another object of the present invention is to provide a golf grip which serves as a training device for achieving the proper grip of the golf club.

Still another object of the present invention is to provide a golf grip which encourages the golfer to overlap their thumbs relative to the center-line of the club shaft to achieve the so-called relative V-position with their hands.

Yet another object of the present invention is to provide means for properly aligning the grip on the club shaft relative to the golf club head.

Such objects are accomplished by providing a first golf club grip embodiment having integral first and second sections. The first section includes a reduced forward portion which is substantially rectangular in cross-section and an enlarged rearward portion which is substantially elliptical in cross-section. The first section is generally tapered from the rearward portion toward the forward portion to naturally encourage the golfer to grip the club near the forward portion. The first section also includes a radially outwardly extending flange disposed on the top of the grip which slopes away from the center-line of the grip. The slop of the flange this encourages the golfer to overlap their thumb on the grip. Extending from the underside of the grip along the forward portion is a hilt which provides a positive stop for the golfer's fingers.

The second section of the grip likewise includes a forward portion having a reduced substantially rectangular shape in cross-section and an enlarged rearward portion having a substantially elliptical shape in cross-section, thereby encouraging the golfer to grip the golf club along the forward portion with their second hand. This second portion is also preferably provided with a radially outwardly extending flange which is sloped away from the center-line in a direction opposite that of the first flange.

Preferably, both flanges are provided with means for enhancing the grip along the flanges and the body of the grip is provided with means for increasing the gripability along the length of the grip.

A second golf club grip embodiment according to the teachings of the present invention includes an enlarged palm area in the form of an arcuate bulge disposed along one side of the first or second sections or along opposite sides of grip along both the first and second sections.

The arcuate bulges are intended to substantially fill the palm area of the user's hand upon gripping the grip.

BRIEF DESCRIPTION OF THE DRAWINGS

Additional benefits and advantages of the present invention will become apparent from a reading of the description of preferred embodiments taken in conjunction with the specific examples provided and the drawings, in which:

FIG. 7 is a partial perspective view of a second golf grip embodiment according to the teachings of the present invention;

FIG. 8 is a cross-sectional view of the golf grip taken along line 8—8 of FIG. 7;

FIG. 9 is a partial perspective view of a third golf grip embodiment according to the teachings of the present invention;

FIG. 10 is a cross-sectional view of the golf grip taken along line 10—10 of FIG. 9;

DETAILED DESCRIPTION OF THE PREFERRED EMBODIMENT

Figure 1:
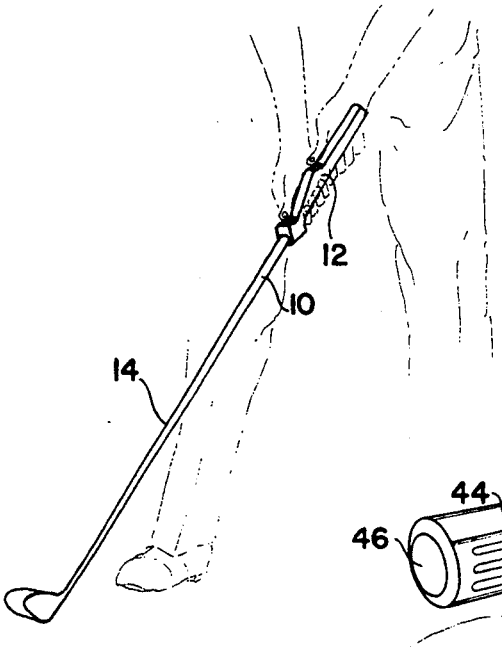
FIG. 1 is a perspective view of an individual gripping a golf club which incorporates a grip according to the teachings of the present invention.
Figure 2:
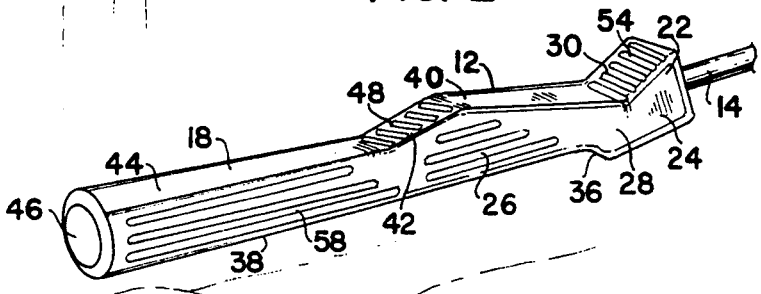
FIG. 2 is a perspective view of the golf grip of FIG. 1.
Figure 3:
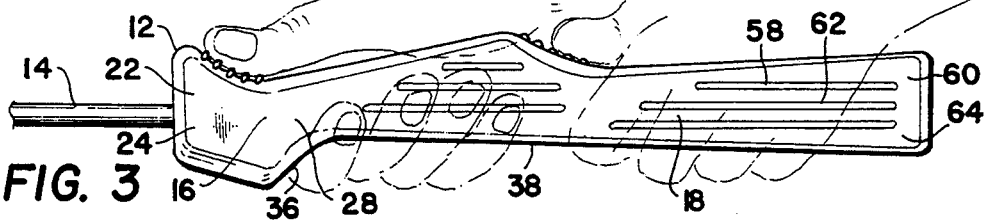
FIG. 3 is a side elevational view of the golf grip of FIG. 1 being grasped by an individual.
Figure 4:
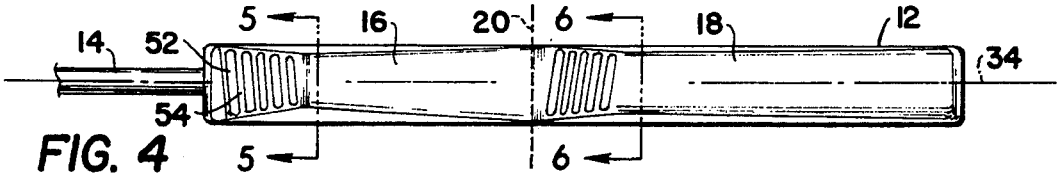
FIG. 4 is a top elevational view of the golf grip according to the teachings of the present invention.

Specialized golf club grips which are useful by golfers of various abilities are provided according to the teachings of the present invention. More particularly, the golf club grips provided under the present invention are useful by a larger percentage of the population, including those having certain physical disabilities such as arthritis or an infirm grip who may not be able to comfortably use a standard sleeve-like golf club grip.

Referring to FIGS. 1 through 4 a first golf club grip embodiment according to the teachings of the present invention is illustrated. The grip 12 which is mounted over the end of a golf club shaft 14 includes first and second integral sections 16 and 18 with the first and second sections 16 and 18, respectively, being distinguished by the section line designated by reference numeral 20 in FIG. 4.

Figure 5:
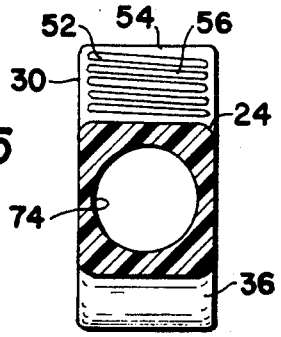
FIG. 5 is a cross-sectional view of the golf grip taken along line 5—5 of FIG. 4.

The first section 16 of the grip includes forward portion 24 located along the first end 22 of grip and a rearward portion 26 extending behind section line 20. The forward portion 24 which is substantially rectangular shaped in cross-section, as shown in FIG. 5, has a reduced diameter as compared to the rearward portion 26 which is substantially elliptical shaped in cross-section. Preferably, the grip 12 tapers consistently downwardly from the rearward portion 26 to the forward portion 24, thus naturally encouraging the golfer to grip the club near the narrower forward portion 24.

Located along the first end 22 is a flange 30 which extends upwardly from the body 28 of the grip along the top 32 of the grip 12. Preferably, the flange 30 slopes downwardly and away from the center-line which is designated by reference numeral 34 to encourage the golfer to overlap their thumb past the center-line 34. Also provided along the first end 22 is a downwardly extending hilt 36 which is positioned on the underside 38 of the grip. The hilt 36 which is spaced slightly farther from the first end 22 than the flange 30 provides a positive stop for the index finger of the golfer's lead hand. Thus, upon gripping the club the golfer's hand is precluded from advancing along the club shaft by both the flange and the hilt. Proximate to the rearward portion 26 of the first section 16 the grip 12 includes a progressively increasing hump portion 40 which also occurs along the top 32 of the grip. This hump 40 is engaged by the golfer's palm upon gripping the club.

Figure 6:
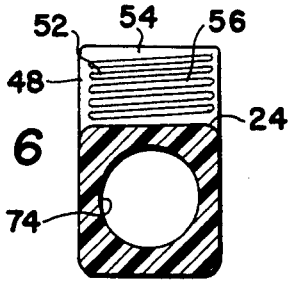
FIG. 6 is a cross-sectional view of the golf grip taken along line 6—6 of FIG. 4.

The second section 18 of the grip 12 also includes a forward portion 42 and a rearward portion 44. The forward portion 42 begins at section line 20 and blends into the rearward portion 44 which terminates at the second end 46 of the golf grip. Located along the forward portion 42, directly behind the hump 40, is a flange 48 which slopes in a direction opposite that of the first flange 30. This too naturally encourages the golfer to overlap the thumb occurring on their second hand past the center-line 34 when they grip the golf club 10. The forward portion 42 of the second section 18 is also substantially rectangular in cross-section as shown in FIG. 6 and has a reduced diameter as compared to the enlarged, elliptical shaped diameter of the rearward portion 50, thus naturally encouraging the golfer to grip the club 10 near the narrower forward portion 42.

Disposed along the body 28 of grip 12 are means 58 for increasing the gripability of the grip 12. The means 58 are generally in the form of a plurality of spaced apart elongated beads 62 extending above the gripping surface 60 on each side 64 of the grip. Optionally, but preferably, one or both flanges 30 and 48, respectively, are provided with grip enhancing means 52. The grip enhancing means typically are in the form of a number of raised ribs 56 which extend above the gripping surface 54 of the flange. It should be noted that alternative means such as a plurality of depressions or grooves extending below the gripping surfaces 54 and 60 could also be utilized and should, therefore, be considered as substitutes.

Figure 11:
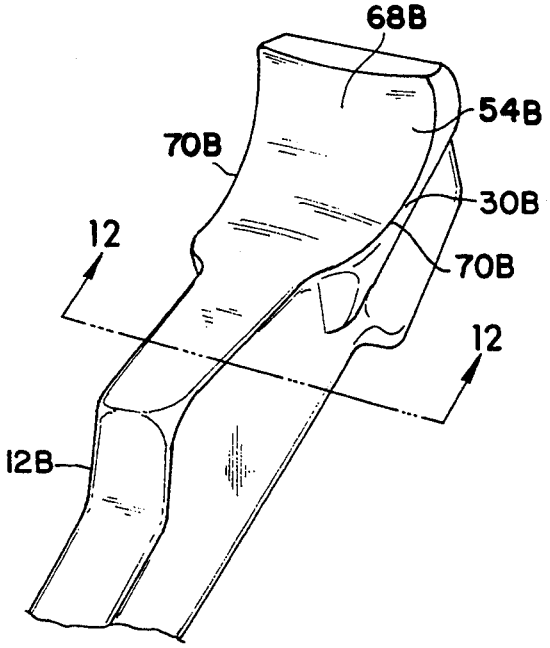
FIG. 11 is a partial perspective view of a fourth golf grip embodiment according to the teachings of the present invention.
Figure 12:
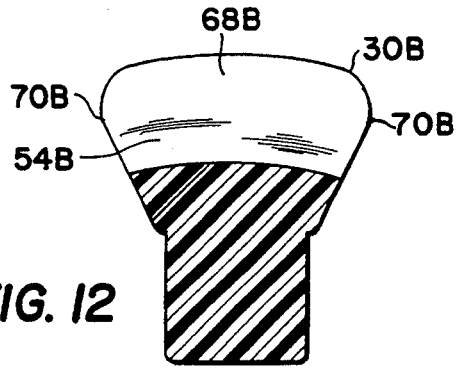
FIG. 12 is a cross-sectional view of the golf grip taken along line 12—12 of FIG. 11.

Referring to FIGS. 7 through 12 alternative golf club grip embodiments are provided according to the teachings of the present invention. The embodiments set forth with reference to FIGS. 7 through 12 are essentially the same as that set forth with reference to FIGS. 1 through 6, except that the forward portion 24 of each grip has been modified. Referring specifically to FIGS. 7 and 8, the forward portion 24A of the golf grip 12A is enlarged to provide sufficient surface area for a modified flange 30A. Under this embodiment, the flange 30A which extends upwardly from the body 28A along the top 32A is contoured such that the gripping surface 54A is substantially arcuate and consistently planar across the gripping surface. The hilt 36A which is positioned on the underside 38A of the grip 12A is again spaced slightly farther from the first end 22A than the flange 30A. Referring to FIGS. 11 and 12, the grip 12B is substantially the same as that of FIGS. 7 and 8 but has been further modified in that the gripping surface 54B of flange 30B is not only substantial arcuate but now is concaved such that the middle portion 68B is lower than both edges 70B. Conversely under the embodiment of FIGS. 9 and 10 the gripping surface 54C is substantially convex with the middle portion 68C being higher than the edges 70C.

Figure 16:
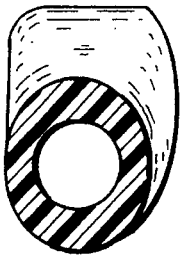
FIG. 16 is a cross-sectional view of the golf grip shown in FIG. 14 taken along line 16—16.

Referring to FIGS. 13 through 20 modified versions of the golf grip 12 of FIGS. 1 through 6 are illustrated. The golf grip 112 includes first and second sections 116 and 118 which are distinguishable by section line 120. The first section 116 includes a forward portion 124 which is substantially rectangular in cross section as demonstrated in FIG. 15 at line 15—15. The forward portion 124 has a reduced diameter as compared to the rearward portion 126 which is substantially elliptical in cross section as shown in FIG. 16 at line 16—16. Preferably, the grip 112 tapers downwardly from the rearward portion 126 to the forward portion 124.

Located along the first end 122 of the grip is a flange 130 which extends upwardly from the body 128 along the top 132 of the grip 112. Preferably, the flange 130 slopes downwardly and away from the center-line which is designated by reference numeral 134 to encourage the golfer to overlap their thumb past the center-line 134. Also provided along the first end 122 is a downwardly extending hilt 136 which is positioned on the underside 138 of the grip. The hilt 136 which is spaced slightly farther from the first end 122 than the flange 130 provides a positive stop for the index finger of the golfer's lead hand. Thus, upon gripping the club the golfer's hand is precluded from advancing along the club shaft by both the flange and the hilt. Extending from the body 128 of the grip between the first portion 124 and the second portion 126 and along a first side 164 of the grip 112 is a bulged portion 180 designed to substantially fill the palm area of the user's right hand upon gripping the club. This bulged portion 180 blends into the progressively increasing hump portion 140 which occurs along the top 132 of the grip. This hump 140 is also generally engaged by a portion of the golfer's palm upon gripping the club.

Figure 17:
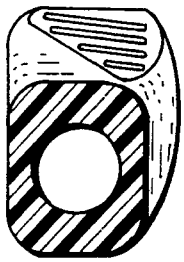
FIG. 17 is a cross-sectional view of the golf grip shown in FIG. 14 taken along line 17—17.
Figure 18:
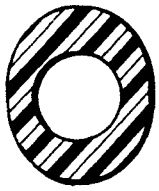
FIG. 18 is a cross-sectional view of the golf grip shown in FIG. 14 taken along line 18—18.

The second section 118 of the grip 112 also includes a forward portion 142 and a rearward portion 144. The forward portion 142 begins at section line 120 and blends into the rearward portion 144 which terminates at the second end 146 of the golf grip. A flange 148 is provided at the forward portion 142, directly behind the hump 140. The flange 148 preferably slopes in a direction opposite that of the first flange 130. This too naturally encourages the golfer to overlap their thumb past the center-line 134 when they grip the golf club 110. The forward portion 142 of the second section 118 is also substantially rectangular in cross-section as shown in FIG. 17 at line 17—17 and has a reduced diameter as compared to the enlarged, elliptical shaped diameter of the rearward portion 144 as shown in FIG. 18 at line 18—18, thus naturally encouraging the golfer to grip the club 110 near the narrower forward portion 142.

Figure 19:
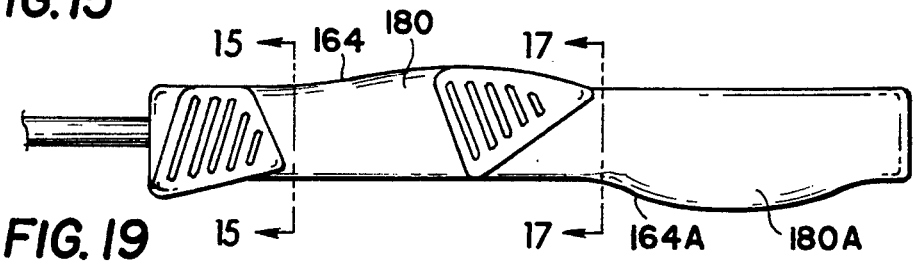
FIG. 19 is a top elevational view of an alternative golf grip embodiment according to the teachings of the present invention.
Figure 20:
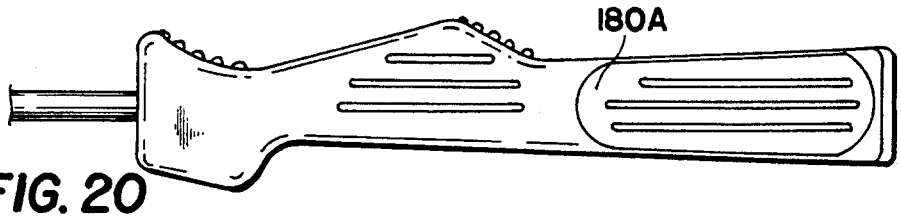
FIG. 20 is a side elevational view of the golf grip of FIG. 19.

Under the embodiment demonstrated in FIGS. 19 and 20 a second bulged portion 180A is provided between the forward portion 148 and the rearward portion 144 on the side 164A of the grip opposite the first side 164. The second bulged portion 180A is intended to substantially fill the palm area of the user's left hand upon gripping the club. While the embodiments set forth with reference to FIGS. 13 through 20 are illustrated for use by a right handed golfer it should be clear to those skilled in the art that the present invention can be modified for use by left handed individuals as well.

Figure 21:
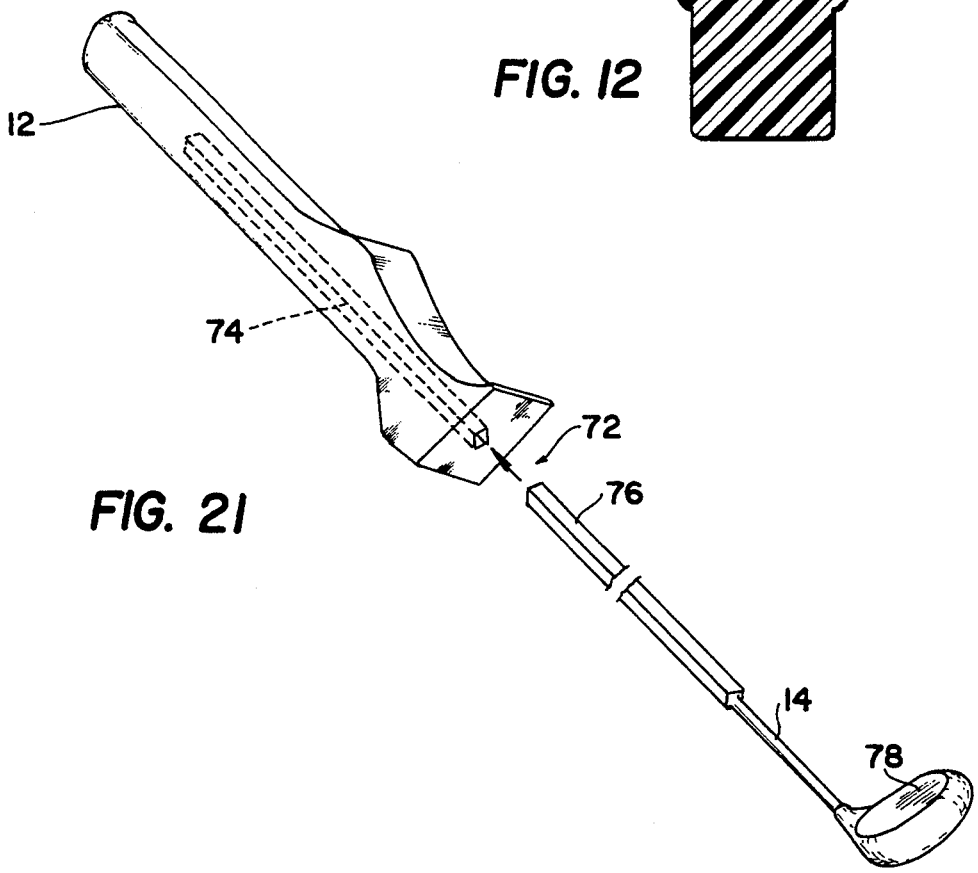
FIG. 21 is a perspective view demonstrating a method of aligning various golf grip embodiments on the golf club shaft.
Figure 13:
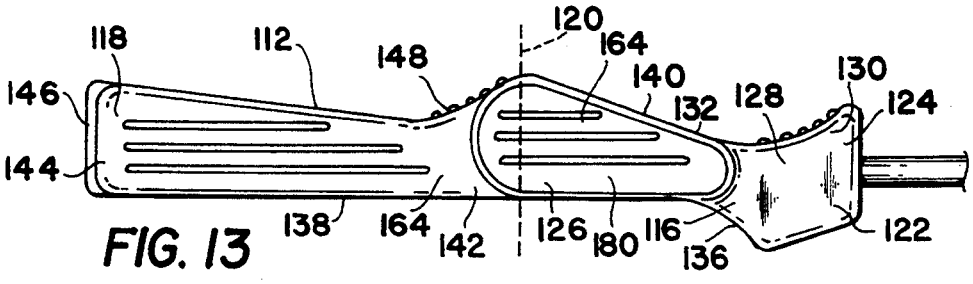
FIG. 13 is a side elevational view of an alternative golf grip embodiment.
Figure 14:
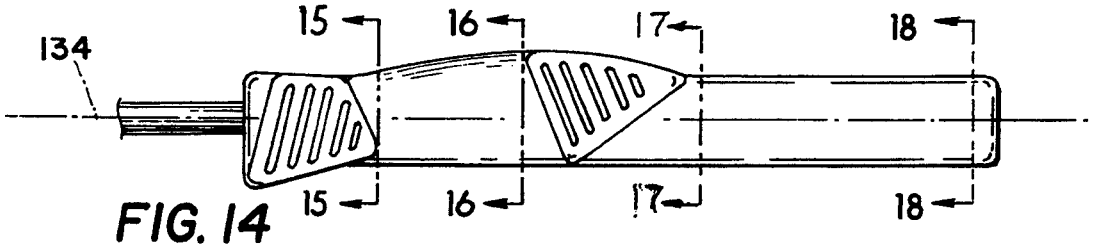
FIG. 14 is a top elevational view of the golf grip of FIG. 13.
Figure 15:
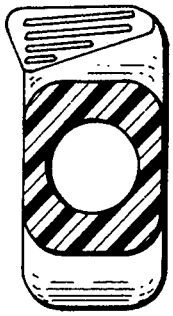
FIG. 15 is a cross-sectional view of the golf grip shown in FIG. 14 taken along line 15—15.

Another aspect of the present invention is illustrated in FIG. 21. According to FIG. 21 means 72 are provided for properly aligning the golf grip 12 relative to the club head 78 upon attachment to the club shaft. The means 72 involve forming the attachment end 76 of the golf club shaft 14 to have a unique cross-sectional geometry to mate with the cavity 74 of the grip which is formed with a mating geometry in cross-section.

For example, the end 76 of the shaft 14 can be formed to have a substantially rectangular geometry in cross-section as shown in FIG. 21. Likewise, the golf grip 12 is formed such that the longitudinally extending cavity 74 has a substantially rectangular geometry in cross-section intended to match that of the golf club shaft end 76. Upon preparing the end of the golf club shaft to adhesively attach the grip as is known in the art, the grip 12 is aligned relative to the end 76 such that the grip can be slipped over the end of the shaft. Because of the unique geometries of the shaft end 76 and the grip cavity 74 the grip 12 can be accurately aligned on the shaft with respect to the position of the club head 78 with little chance of misalignment. In the event that there is misalignment between the grip and the club shaft the grip will not fit over the shaft thus precluding attachment of the grip to the club shaft.

Although the means 72 have been described for exemplary purposes as involving club shaft ends and grip cavities which are rectangular in cross-section, it should be clear to one skilled in the art that other geometries will serve the same purpose and are to be considered as equivalents according to the teachings of the present invention. Essentially, any making geometric shapes which are non-spherical in cross-section will be available. The means 72 provide a check mechanism other than a purely visual one which is utilized under current practice to ensure that the golf club grip is properly aligned on the club shaft relative to the club head.

It should be noted that the means 72 should be considered as equally applicable to both standard sleeve-like golf club grips and specialized golf club grips.

Clearly, while particular embodiments of the present invention have been illustrated and described, it would be obvious to those skilled in the art that various changes and modifications can be made without departing from the spirit and scope of the invention. It is, therefore, intended to cover in the appended claims all such changes and modifications that are within the scope of this invention.

What is claimed is:

1. A grip, comprising:

an elongated body including first and second integral sections and having a cavity for receiving a shaft extending at least partially therethrough, said first section including a first reduced forward portion having a substantially rectangular shape in cross-section and a :first enlarged rearward portion having a substantially elliptical shape in cross-section wherein said body of the grip tapers downwardly from said first rearward portion toward said first forward portion, said first forward portion including a first flange extending radially outwardly from said body along a top surface of said grip, said second section including a second reduced forward portion having a substantially rectangular shape in cross-section and a second enlarged rearward portion having a substantially elliptical shape in cross-section wherein said body of the grip tapers downwardly from said second rearward portion toward said second forward portion, said second forward portion including a flange extending radially outwardly from said body along said top surface of the grip.

2. The grip of claim 1, wherein said first flange includes a gripping surface which is substantially planar.

3. The grip of claim 1, wherein said first flange includes a gripping surface which slopes away from the center-line of the grip.

4. The grip of claim 3, wherein said second flange includes a gripping surface which slopes away from the center-line of the grip in a direction opposite that of said first flange.

5. The grip of claim 4, wherein said second flange is provided with means for enhancing said gripping surface of said second flange.

6. The grip of claim 5, wherein said means for enhancing said gripping surface includes a plurality of ribs extending from said gripping surface.

7. The grip of claim 1, wherein said second flange includes a gripping surface which is relatively planar.

8. The grip of claim 1, wherein said first flange is provided with means for enhancing a gripping surface of said first flange.

9. The grip of claim 8, wherein said means for enhancing said gripping surface includes a plurality of ribs extending from said gripping surface.

10. The grip of claim 1, further comprising means disposed along said body for increasing the gripability of the grip.

11. The grip of claim 10, wherein said means for increasing said gripability of said grip along the body includes a plurality of extending beads.

12. The grip of claim 1, wherein the grip is made from an elastomeric or polymeric material, or a combination thereof.

13. The grip of claim 1, wherein said first flange includes a gripping surface that is contoured such that said gripping surface is substantially arcuate.

14. The grip of claim 13, wherein said first flange is contoured such that said gripping surface is concaved.

15. The grip of claim 1, wherein said first flange includes a gripping surface that is contoured such that said gripping surface is convex.

16. The grip of claim 1, further comprising a hilt disposed along a first end of the grip and which extends radially outwardly from said body along an underside surface of the grip.

17. The grip of claim 1, further comprising a first bulged portion extending between said first forward portion and the first rearward portion along one side of said grip.

18. The grip of claim 17, further comprising a second bulged portion extending between said second forward portion and said second rearward portion along a second side of the grip.

19. An improved club assembly comprising:

a shaft;

a club head fixed to a first end of said shaft;

a grip fixed to a second end of said shaft, said grip comprising an elongated body including first and second integral sections and having a cavity for receiving said second end of said shaft, said first section including a first reduced forward portion having a substantially rectangular shape in cross-section and a first enlarged rearward portion having a substantially elliptical shape in cross-section wherein said body of said grip tapers downwardly from said first rearward portion toward said first forward portion, said first forward portion including a first flange extending radially outwardly from said body along a top surface of said grip, said second section including a second reduced forward portion having a substantially rectangular shape in cross-section and a second enlarged rearward portion having a substantially elliptical shape in cross-section wherein said body of said grip tapers downwardly from said second rearward portion toward said second forward portion, said second forward portion including a flange extending radially outwardly from said body along said top surface of said grip; and means for mechanically aligning said grip over said second end of said shaft in proper axial alignment relative to the position of said club head.

20. The improved club assembly of claim 19, wherein said means for mechanically aligning said grip over said shaft includes a grip attachment formed at said second end of said shaft with a cross-sectional geometry which is non-spherical, said grip including a cavity for receiving said attachment end, said cavity having the identical cross-sectional geometry as that of said attachment end of said shaft.

21. The improved club assembly of claim 20, wherein said attachment end has a substantially rectangular shape in cross-section.

* * * * *